US009081315B2

(12) United States Patent
Gilson et al.

(10) Patent No.: US 9,081,315 B2
(45) Date of Patent: Jul. 14, 2015

(54) PHOSPHORESCENT TONER AND METHODS OF FORMING AND USING THE SAME

(75) Inventors: Carrie A. Gilson, Wheeling, WV (US); Kevin L. Heilman, Wheeling, WV (US); Michael R. Riley, Steubenville, OH (US)

(73) Assignee: TROY GROUP, INC., Costa Mesa, CA (US)

( * ) Notice: Subject to any disclaimer, the term of this patent is extended or adjusted under 35 U.S.C. 154(b) by 0 days.

(21) Appl. No.: 13/450,214

(22) Filed: Apr. 18, 2012

(65) Prior Publication Data

US 2013/0280648 A1 Oct. 24, 2013

(51) Int. Cl.

| | |
|---|---|
| ***G03G 9/09*** | (2006.01) |
| ***G03G 9/08*** | (2006.01) |
| ***G03G 9/097*** | (2006.01) |

(52) U.S. Cl.

CPC ..... *G03G 9/0819* (2013.01); *G03G 9/081* (2013.01); *G03G 9/0821* (2013.01); *G03G 9/0902* (2013.01); *G03G 9/0926* (2013.01); *G03G 9/09783* (2013.01); *Y10T 428/2982* (2015.01)

(58) Field of Classification Search

USPC ..... 430/108.1, 108.3, 108.8, 109.3

See application file for complete search history.

(56) References Cited

U.S. PATENT DOCUMENTS

| | | | | |
|---|---|---|---|---|
| 2003/0054277 | A1* | 3/2003 | Fujikura | 430/108.1 |
| 2006/0001007 | A1* | 1/2006 | Fukui | 252/301.4 F |
| 2010/0062360 | A1 | 3/2010 | Victor | |
| 2010/0330487 | A1* | 12/2010 | Veregin et al. | 430/108.4 |

FOREIGN PATENT DOCUMENTS

| | | |
|---|---|---|
| WO | 2008/136041 | 11/2008 |

* cited by examiner

*Primary Examiner* — Peter Vajda

(57) ABSTRACT

A toner composition including at least one phosphorescent pigment that absorbs energy released by natural or artificial light, and is able to be seen in a dark environment through luminescence of a certain color created by the energy released as light, and a method of forming and using the toner are described. The phosphorescent toner has a particle size in the range of about 15-40 microns, which allows the toner to have the ability to absorb and then release the needed amount of light energy to be noticeable in a dark environment.

11 Claims, 1 Drawing Sheet

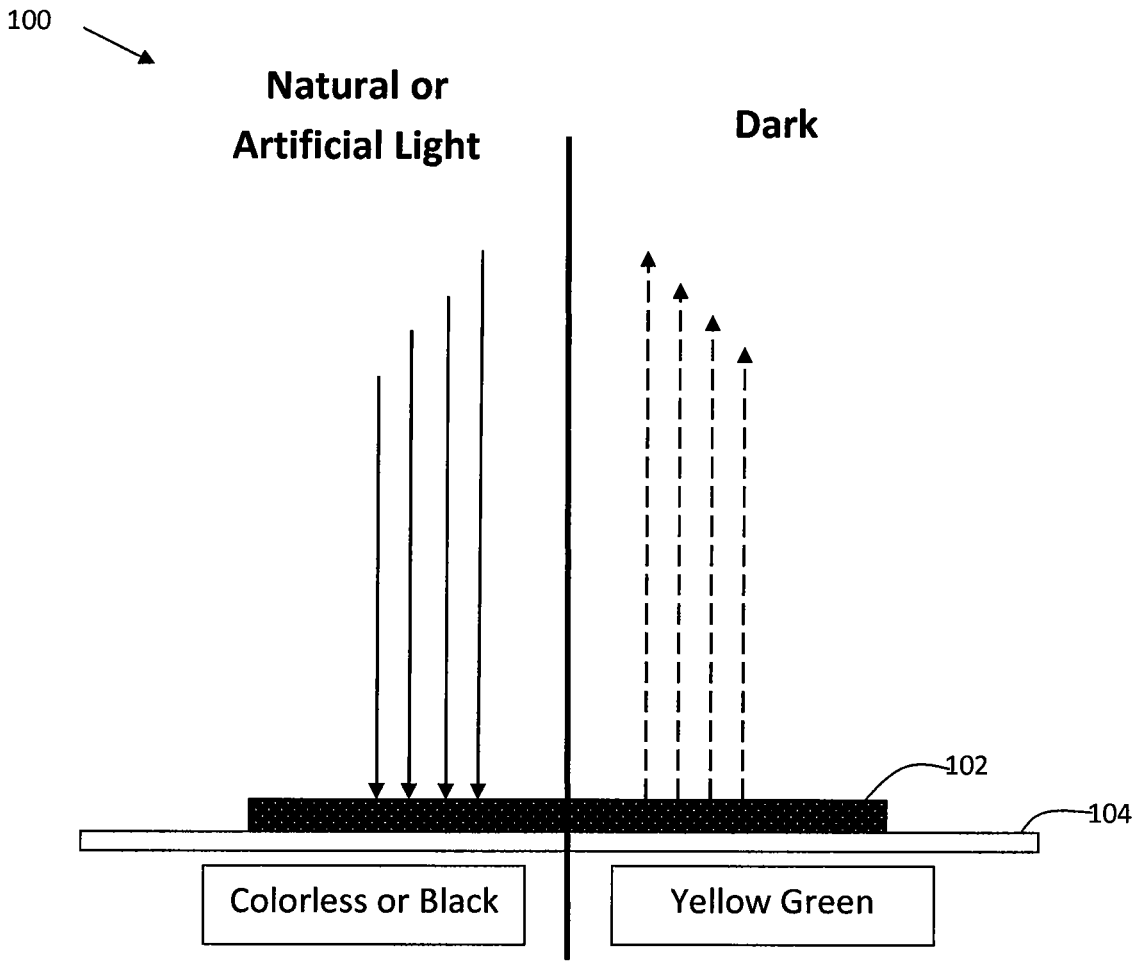
100
Natural or
Artificial Light
Dark
102
104
Colorless or Black
Yellow Green

PHOSPHORESCENT TONER AND METHODS OF FORMING AND USING THE SAME

FIELD OF INVENTION

The present invention generally relates to apparatus and methods for printing and copying documents. More particularly, the invention relates to a toner that includes phosphorescent material for producing a phosphorescent image on a substrate, to a device including the substrate and the toner, and to methods of forming and using the toner.

BACKGROUND OF THE INVENTION

Toner-based document imaging, such as electrophotographic, ionographic, magnetographic, and similar imaging techniques, generally involves forming an electrostatic or magnetic image on a charged or magnetized photoconductive plate or drum, brushing the plate or drum with charged or magnetized toner, transferring the image onto a substrate such as paper, polyester film, or the like, and fusing the toner onto the substrate using heat, pressure, and/or a solvent. Using this technique, relatively inexpensive images can be easily formed on a surface of the substrate.

Because toner-based imaging is a relatively quick and inexpensive technique for producing copies of images, the technique is often employed to produce documents that were traditionally formed using other forms of printing or imaging—e.g., impact printing, off-set printing presses, or ink-jet printing. For example, in recent years, toner-based imaging has been employed to produce financial documents, such as personal checks, stocks, and bank notes; legal documents such as wills and deeds; medical documents such as drug prescriptions and doctors' orders; and the like. Unfortunately, because the image is formed on the surface of the substrate, documents produced using toner-based imaging techniques are relatively easy to forge and/or duplicate. Recently, specialty toners with unique security features have been developed to address the growing problem of document fraud that presently exists in a wide variety of markets.

U.S. Pat. No. 5,714,291, issued to Marinello et al. on Feb. 3, 1998, discloses a toner that includes submicron ultraviolet sensitive particles, which emit light of a specific ultraviolet wavelength(s). A document can be verified by using a scanner that reads the specific ultraviolet wavelengths(s). Requiring use of an ultraviolet scanner is generally undesirable because it requires additional equipment and adds significant cost to a forgery analysis.

United States Publication No. US2003/0054277, in the name of Fujikura, dated Mar. 20, 2003, discloses a dual-component toner containing phosphorescent pigment and a binder resin. The toner includes phosphorescent pigment having a particle diameter falling within a range of between 0.01 μm and 9.0 μm. According to the reference, if the particle diameter is larger than 7.0 μm, the phosphorescent pigment tends to be separated from within the toner particle. If the toner includes a colorant or a developing agent, the toner is formed in a multi-step process, which includes forming a master batch, which in the case of a toner including a colorant is prepared by sufficiently dispersing the coloring agent in a suitable amount of the binder resin, and adding the remaining binder resin to the master batch. Then, the mixture is melted and kneaded, following by a pulverizing and classification process. Although this toner and process appear to work for certain applications, the particle size of the phosphorescent material is relatively small, which reduces an amount of brightness of the phosphorescent material. In addition, the process requires a separate master batch step, which requires additional time and expense.

United States Publication No. US2010/0062360, in the name of Victor, dated Mar. 11, 2010 discloses methods of making ink toners for use in electrostatic imaging. The reference notes that current methods of making optically variable ink toners for use in electrostatic printing are not operable, and that current methods destroy the pigments present in the ink toner. United States Publication No. US2010/0330487, in the name of Veregin et al., dated Dec. 30, 2010, states that while commercial phosphorescent pigments exist, they are too large to be incorporated into toner particles and therefore it has not been possible to directly prepare phosphorescent electrophotographic prints. Veregin further states that both chemical and conventional toner processes currently available will fail to incorporate these large pigments. Veregin et al. purports to overcome this problem by coating the phosphorescent material, which is relatively time consuming and expensive.

For the foregoing reasons, improved methods and apparatus for forming documents having a phosphorescent image using toner-based processing, which are relatively easy and inexpensive, are desired.

SUMMARY OF THE INVENTION

The present invention provides an improved toner for producing phosphorescent images and improved methods of forming and using the toner. In addition to addressing the various drawbacks of the now-known toners and methods, in general, the invention provides a toner that produces images that will glow in the dark for an extended period of time after the toner has been exposed to natural or artificial light and which are relatively easy and inexpensive to manufacture. As set forth in more detail below, the toner, device and method described herein can be used for secure printing and copying applications, as well as for printing or copying on-demand documents, signs, and the like, which may be used for business, comfort, safety, or amusement.

In accordance with various embodiments of the invention, a toner includes a phosphorescent pigment and optionally includes a colorant. The phosphorescent pigment glows in the dark for an extended period of time after it has been exposed to natural and/or artificial light. In accordance with various aspects of these embodiments, the phosphorescent pigment material is not coated prior to mixing with other toner components. In accordance with further aspects, the phosphorescent pigment material has a particle diameter size of about 15 μm to about 55 μm or about 20 μm to about 40 μm. In accordance with further aspects of these embodiments, the toner includes a colorant (optional), a thermoplastic resin binder, a charge-controlling agent, a release agent, as well as the phosphorescent pigment.

In accordance with additional embodiments of the invention, a method of forming a toner includes melt-blending binder resin particles, mixing colorant particles (optional), charge-control agents, release agents, (uncoated) phosphorescent pigment, cooling the mixture, classifying the mixture, and dry blending the classified mixture with inorganic materials. In accordance with alternative embodiments of the invention, the toner is formed using melt dispersion, dispersion polymerization, suspension polymerization, or spray drying. Regardless of the technique, the toner, including an optional colorant and phosphorescent pigment, having a particle diameter size of about 15 μm to about 55 μm or about 20

μm to about 40 μm, can be formed without the step of forming a master batch or coating the phosphorescent material in a separate step.

In accordance with yet additional embodiments of the invention, a device includes a substrate (e.g., paper or film) and a phosphorescent image printed using a toner. The phosphorescent image may appear colorless when no additional colorant is used, and creates a glow-in-the-dark image on the surface of the substrate. In accordance with various aspects of these embodiments, the device further includes a colorant on a surface of the substrate. The colorant may form part of the image or may form a distinct image.

BRIEF DESCRIPTION OF THE DRAWING FIGURE

A more complete understanding of the present invention may be derived by referring to the detailed description and claims, considered in connection with the drawing FIGURE, which illustrates a device in accordance with exemplary embodiments of the invention.

Skilled artisans will appreciate that elements in the FIGURE are illustrated for simplicity and clarity and have not necessarily been drawn to scale. For example, the dimensions of some of the elements in the FIGURE may be exaggerated relative to other elements to help to improve understanding of embodiments of the present invention.

DETAILED DESCRIPTION

The following description is provided to enable a person skilled in the art to make and use the invention and sets forth the best mode contemplated by the inventors of carrying out their invention. Various modifications to the description, however, will remain readily apparent to those skilled in the art, since the general principles of a phosphorescent toner for forming a glow-in-the-dark image and methods of forming and using the toner are defined herein.

The drawing FIGURE illustrates a device 100, including an image 102 formed on a surface of a substrate 104. As set forth in more detail below, image 102 contains phosphorescent pigment that when placed in natural or "artificial" light absorbs the light as a form of energy. This energy is then released as light when device 100 is placed in a dark environment, such that the image glows in the dark for an extended period of time.

Image 102 may be used as a security feature that may not be noticeable to the eye, until after exposure to natural light or "artificial" light and subsequent placement in a dark environment. The inclusion of phosphorescent material in a toner used to produce image 102 permits low-cost, on-demand printing, which can be used for a variety of applications, including informative information for covert images, signs for disaster prevention, safety images for environments, such as theaters, sporting events, street festivals, and the like, as well as security applications. Attempted forgery of a document can be verified by, for example, verifying phosphorescent image 102 and/or comparing image 102 (with phosphorescent material) with an image visible under ambient lighting conditions.

Image 102 is printed onto substrate 104 by transferring toner onto substrate using, for example, an electrostatic or electrophotographic process. In this case, the toner is transferred to a portion of the substrate to create a desired image and the image is fused to the substrate using, for example, heat and/or vapor solvent processing. The electrostatic or electrophotographic process may include a mono-component developer system, a two-component developer system, or a vapor fusing system.

In addition to the phosphorescent material, image 102 may additionally include a colorant to form an image that is visible under normal or ambient lighting conditions. The colorant may be used to form the same image 102 as the image 102 formed using the phosphorescent material. Alternatively, the colorant image may be separately formed and not necessarily coextensive with phosphorescent image 102. In accordance with one particular example, when no colorant is included in the toner, the resulting image 102 is colorless to gray.

Substrate 104 may include any suitable material, such as paper (e.g., multipurpose paper, dead paper having no brightener added), fabric, multiple-layer media (typically consists of a face sheet or printable surface, pressure-sensitive adhesive, and a carrier sheet coated with a release agent), any number of polymer substrates such as PET, MET-PET, LDPE, HDPE, BOPP, MET-BOPP, CPP, and the like.

The toner used to form image 102 may be suitable for a mono-component developer system, a two-component developer system, or a vapor fusing system. An exemplary toner includes phosphorescent pigment, a thermoplastic binder resin, optionally a colorant, a charge-controlling agent, and optionally a releasing agent. Each of the thermoplastic binder resin, the colorant, and the charge-controlling agent may be the same as those used in typical toners.

The thermoplastic binder resin helps fuse the toner to the substrate. In accordance with one embodiment of the invention, the binder resin has a melt index of between about 1 g/10 min. and 50 g/10 min. at 125° C. and glass transition temperature between about 50° C. and about 65° C. Exemplary materials suitable for the thermoplastic binder resin include one or more of the following: polyester resins, styrene copolymers and/or homopolymers—e.g., styrene acrylates, methacrylates, styrene-butadiene—epoxy resins, latex-based resins, bio-based polymer resins or any hydrocarbon resin used to manufacture electrostatic toner. By way of particular example, the thermoplastic binder resin is a styrene acrylic copolymer sold by Nashua Corporation as C400 resin.

When included in the toner, the colorant can be any colorant of any suitable color used for electrophotographic image processing, such as one or more of: iron oxide, other magnetite materials, carbon black, manganese dioxide, copper oxide, and aniline black.

The phosphorescent pigment for use in this toner can be any material including phosphorescent pigments selected from a group consisting of calcium sulfide, zinc sulfide, strontium aluminate, strontium aluminate oxide, other alkaline earth aluminates and alkaline earth metal aluminate oxides, and phosphors represented by the general formula: $MO.mAl_2O_3$:Eu2+,R3+, wherein m is a number ranging from about 1.6 to about 2.2, M is Sr or a combination of Sr with Ca and Ba or both, R3+ is a trivalent metal ion or trivalent Bi or a mixture of these trivalent ions, Eu2+ is present at a level up to about 5 mol % of M, and R3+ is present at a level up to about 5 mol % of M, and combinations of such materials.

The average particle diameter size of the phosphorescent pigment may vary according to application and other factors. In accordance with exemplary embodiments of the invention, the average particle size ranges from about 15 μm to about 55 μm, or about 20 μm to about 40 μm, or about 15 μm to about 25 μm, or about 45 μm to about 55 μm, or about 35 μm to about 45 μm, or about 20 μm.

Similarly, an amount of the phosphorescent pigment can vary according to desired properties of image 102. Exemplary toners include about 5 wt % to about 35 wt %, or about 10 wt % to about 35 wt %, or about 25 wt % to about 30 wt % phosphorescent pigment.

The charge-control agent helps maintain a desired charge within the toner to facilitate transfer of the image from, for example, an electrostatic drum, to the substrate. In accordance with one embodiment of the invention, the charge control agent includes negatively or positively charged control compounds that are metal-loaded or metal free complex salts, such as copper phthalocyanine pigments, zinc complex salts, aluminum complex salts, quaternary fluoro-ammonium salts, chromium complex salt type axo dyes, chromic complex salt, and calix arene compounds.

As noted above, the toner may also include a releasing agent such as a wax. The releasing agent may include one or more of low molecular weight polyolefins or derivatives thereof, such as polypropylene wax or polyethylene wax.

An exemplary toner is formed by initially melt-blending the binder resin particles. The (optional) colorant, charge controlling agent(s), (optional) release agent(s), and phosphorescent pigment(s) are admixed to the binder resin particles by mechanical attrition. The mixture is then cooled and then micronized by air attrition. The micronized particles that are between about 0.1 and 45 microns in size are classified to remove fine particles, leaving a finished mixture having particles of a size ranging from about 15 to about 55 microns, or about 20 to about 40 microns, or about 15 to about 40 microns, or about 20 microns, or about 40 microns. The classified toner can then be dry blended with finely divided particles of inorganic materials such as silica and titania. The inorganic materials are added to the surface of the toner for the primary purpose of improving the flow of the toner particles, improving blade cleaning of the photoresponsive imaging surface, increasing the toner blocking temperature, and assisting in the charging of the toner particles. Alternatively, the phosphorescent toner can be made by other types of mixing techniques such as melt dispersion, dispersion polymerization, suspension polymerization, emulsification, and spray drying. Note that the method of forming a toner described herein does not require the formation of a master batch or prior coating of the phosphorescent material, even when the toner includes a colorant, and thus the toner can advantageously be formed relatively quickly and inexpensively, compared to prior-art techniques. In addition, the size of the particles is much larger than typical prior-art toners including phosphorescent pigment, providing brighter and longer glowing images printed using the toner described herein.

The following non-limiting examples illustrate various combinations of materials and processes useful in forming a toner in accordance with various embodiments of the invention. These examples are merely illustrative, and it is not intended that the invention be limited to these illustrative examples.

Example I

The following example illustrates a preparation of a 20-micron phosphorescent toner for the use in electrophotographic printing. This specific example used a 15 micron phosphorescent pigment from Lightleader Company. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 20 microns.

| Component | Chemical | Manufacturer | Exemplary Range (weight parts) | Specific Example (weight parts) |
|---|---|---|---|---|
| Thermoplastic Binder Resin | Polyester | Mitsui Toatsu Chemicals Almatex XPE-1676 | 20-50 | 47 |
| Thermoplastic Binder Resin | Styrene Acrylic | Nashua Corporation C400 | 20-50 | 23 |
| Charge-Controlling Agent | Zinc Salicylate | Orient Chemical Company-Bontron E404 | 0-3 | 1 |
| Phosphorescent Pigment | Alkaline earth aluminate | Lightleader Company (15 um) YG-1E | 5-35 | 25 |
| Releasing Agent | Polypropylene | Mitsui Petrochemical 56 copolymer wax | 0-15 | 4 |

This prepared mono-component toner is loaded into a Lexmark cartridge part number 64015HA intended for the Lexmark T640 printer. When printed on a substrate such as a multipurpose 20 lb paper, a grey image was formed using this toner. The printed image was exposed to natural sun light for over ten minutes to absorb light energy. When the printed image was taken in a dark environment, the printed image glowed a yellow green light in the dark. This yellow green glow in the dark environment remained until the absorbed light dissipated. Additional samples were made on different substrates, including optically dead paper (no brightener added to the paper during paper pulp manufacturing) and a polyester film substrate. The samples once again printed with a gray visible image. The images were exposed to natural light and then taken to a dark environment. The images on these substrates had a vibrant yellow green glow in the dark that remained until the absorbed light dissipated.

Example II

The following example illustrates a preparation of a 20-micron phosphorescent toner.

| Component | Chemical | Manufacturer | Exemplary Range (weight parts) | Exemplary Composition (weight parts) |
|---|---|---|---|---|
| Thermoplastic Binder Resin | Polyester | Mitsui Toatsu Chemicals Almatex XPE-1676 | 20-50 | 47 |
| Thermoplastic Binder Resin | Styrene Acrylic | Nashua Corporation C400 | 20-50 | 23 |
| Charge-Controlling Agent | Zinc Salicylate | Orient Chemical Company-Bontron E404 | 0-3 | 1 |
| Phosphorescent Pigment | Alkaline earth aluminate | Jinan Realglow Luminous Technology, (15-25 um) PYG-6S | 5-35 | 25 |
| Releasing Agent | Hydrocarbon | Shamrock Technologies S-379H Wax | 0-15 | 1 |
| Releasing Agent | Polypropylene | Mitsui Petrochemical HI 0704 Wax | 0-15 | 3 |

The toner composition of Example II is formed in same way as the toner of Example I, except the phosphorescent pigment was changed to one provided by Jinan Realglow Luminous Technology and the pigment was 15-25 micron particle size. The prepared mono-component toner was again tested using a mono-component printer such as a Lexmark T640. The resulting gray image was noticeable, but faint. To verify that the resulting image containing the phosphorescent pigment could retain energy from artificial light, the resulting image was left in a normal office environment that used fluorescent lighting. The printed image was then placed into a dark environment. There was a yellow green glow similar to the glow that was created by natural light.

Example III

The following example illustrates a preparation of a 20-micron phosphorescent toner for the use in electrophotographic printing. This specific example used a 45-55 micron phosphorescent pigment from JASH Marketing. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 20 microns.

| Component | Chemical | Manufacturer | Exemplary Range (weight parts) | Exemplary Composition (weight parts) |
|---|---|---|---|---|
| Thermoplastic Binder Resin | Polyester | Mitsui Toatsu Chemicals Almatex XPE-1676 | 45-90 | 70 |
| Charge-Controlling Agent | Zinc Salicylate | Orient Chemical Company-Bontron E404 | 0-3 | 1 |
| Phosphorescent Pigment | Alkaline earthmetal aluminate oxide | JASH Marketing, (45-55 um) JG-201 | 5-35 | 25 |
| Releasing Agent | Polypropylene | Mitsui Petrochemical 056 copolymer Wax | 0-15 | 4 |

This prepared mono-component toner is loaded into a Lexmark cartridge part number 64015HA intended for the Lexmark T640 printer. Once again, when printed on a substrate such as a multipurpose 20 lb paper, a grey image was formed using this toner. The printed image was exposed to natural sun light for over ten minutes to absorb energy from the natural light. When the printed image was taken in a dark environment the printed image was luminescent with a yellow green light in the dark. This yellow green image was noticeable in the dark environment until the absorbed energy had dissipated. Additional samples were printed on the polyester substrate. The word "exit" was printed on the polyester substrate and the printed sample was placed over a doorway. The printed sample was gray in color in artificial light. This sample remained in artificial light, until the light was removed by turning off the lights in the room. Inside the dark room, a light yellow green glow of the word "exit" was noticed.

Example IV

The following example illustrates a preparation of a 40-micron phosphorescent toner for the use in electrophotographic printing. This specific example used a 35-45 micron phosphorescent pigment from Qingdao Roadsun Titanos Ind. Co. A toner composition containing the specific composition tabulated below is initially thoroughly pre-mixed and then melt mixed in a roll mill. The resulting polymer mix is cooled and then pulverized by a Bantam pre-grinder (by Hosokawa Micron Powder System). The larger ground particles are converted to toner by air attrition and classified to a particle size with a median volume (measured on a Coulter Multisizer) of approximately 40 microns.

| Component | Chemical | Manufacturer | Exemplary Range (weight parts) | Exemplary Composition (weight parts) |
|---|---|---|---|---|
| Thermoplastic Binder Resin | Styrene Acrylic | Nashua Corporation C400 | 20-50 | 37.5 |
| Thermoplastic Binder Resin | Styrene Acrylic | Nashua Corporation D30 | 5-25 | 15 |
| Thermoplastic Binder Resin | Styrene Butadiene | ElioKem Pliolite S5A | 5-25 | 9 |
| Thermoplastic Binder Resin | Styrene | Exxon Mobile Chemicals Escorez 1304 | 2-10 | 5 |
| Charge-Controlling Agent | Zinc Salicylate | Orient Chemical Company-Bontron E84 | 0-3 | 0.5 |
| Phosphorescent Pigment | Alkaline earth aluminate | Qingdao Roadsun Titanos Ind Co. LTD, (35-45 um) YG-101 | 5-35 | 30 |
| Releasing Agent | Polypropylene | Mitsui Petrochemical 056 copolymer Wax | 0-15 | 3 |

A prepared mono-component toner of Example IV is loaded into a Hewlett Packard black cartridge part number CE250A intended for the Color LaserJet CP3525. When printed on a substrate such as a multipurpose 20 lb paper, a grey image was formed using this toner. The printed image was allowed to absorb energy from natural sun light for over ten minutes. When the printed image was taken in a dark environment, the printed image was luminescent in a yellow green color until the absorbed energy dissipated. Additional samples were made on different substrates, including optically dead paper (no brightener added to the paper during paper pulp manufacturing) and a polyester film substrate with similar results.

Although the present invention is set forth herein in the context of the appended drawing FIGURE, it should be appreciated that the invention is not limited to the specific form shown. For example, while the invention is conveniently described in connection with electrostatic printing, the invention is not so limited; the toner of the present invention may be used in connection with other forms of printing—such as iongraphic, magnetographic, and similar imaging techniques Various other modifications, variations, and enhancements in the design and arrangement of the method and device set forth herein, may be made without departing from the spirit and scope of the present invention as set forth in the appended claims.

What is claimed is:

1. A phosphorescent toner for producing a phosphorescent image on a substrate by an electrophotographic process, the phosphorescent toner comprising:

a total amount of thermoplastic resin binder; and an uncoated phosphorescent pigment for forming a phosphorescent image on the substrate, the uncoated phosphorescent pigment having been melt-blended with the total amount of the thermoplastic resin binder in a single melt-mix process and micronized after the single melt-mix process, the uncoated phosphorescent pigment comprising a material selected from a group consisting of calcium sulfide, zinc sulfide, strontium aluminate, strontium aluminate oxide, other alkaline earth aluminates and alkaline earth metal aluminate oxides, phosphors represented by the general formula: $MO.mAl_2O_3:Eu^{2+},R^{3+}$, wherein m is a number ranging from about 1.6 to about 2.2, M is Sr or a combination of Sr with Ca and Ba or both, $R^{3+}$ is a trivalent metal ion or trivalent Bi or a mixture of these trivalent ions, $Eu^{2+}$ is present at a level up to about 5 mol % of M, and $R^{3+}$ is present at a level up to about 5 mol % of M, and combinations of the materials, wherein the phosphorescent toner has an average particle size in the range of about 15 μm to about 55 μm after micronization.

2. The phosphorescent toner of claim 1, wherein the average particle size is about 20 μm to about 40 μM.

3. The phosphorescent toner of claim 1, wherein the uncoated phosphorescent pigment is present in the range of about 5% to about 35% by weight.

4. The phosphorescent toner of claim 1, wherein the thermoplastic resin binder comprises a material selected from the group consisting of one or more of the following: polyester resins, styrene homopolymers, styrene copolymers, epoxy resins, latex-based resins, and bio-based polymer resins.

5. The phosphorescent toner of claim 1, further comprising a charge-controlling agent.

6. The phosphorescent toner of claim 5, wherein the charge-controlling agent comprises a material selected from the group consisting of copper phthalocyanine pigments, zinc complex salts, aluminum complex salts, quaternary fluoro-ammonium salts, chromium complex salt type axo dyes, chromic complex salt, and calix arene compounds.

7. The phosphorescent toner of claim 1, further comprising a colorant.

8. The phosphorescent toner of claim 7, wherein the colorant is selected from one or more of the group consisting of iron oxide, magnetite materials, carbon black, manganese dioxide, copper oxide, and aniline black.

9. The phosphorescent toner of claim 1, further comprising a releasing agent.

10. The phosphorescent toner of claim 9, wherein the releasing agent comprises a material selected from the group consisting of one or more of polyolefins and derivatives of polyolefins.

11. The phosphorescent toner of claim 1, wherein the toner is configured for use in one of: a mono-component developer system, a two-component developer system, or a vapor fusing system.

* * * * *